United States Patent [19]

Poitras et al.

[11] Patent Number: 4,679,709

[45] Date of Patent: Jul. 14, 1987

[54] DISPENSER MOUNTING SYSTEM

[75] Inventors: James W. Poitras, Holliston; Edwin W. Wlodyka, Ashland, both of Mass.

[73] Assignee: Highland Laboratories, Ashland, Mass.

[21] Appl. No.: 743,941

[22] Filed: Jun. 12, 1985

[51] Int. Cl.[4] ..... B67D 5/06

[52] U.S. Cl. ..... 222/180; 248/222.1; 248/223.4; 248/224.1; 292/76

[58] Field of Search ..... 222/180, 181; 248/221.3, 222.1, 223.4, 224.1; 292/76; 312/352; 24/616, 617, 115 M

[56] References Cited

U.S. PATENT DOCUMENTS

| | | | |
|---|---|---|---|
| 1,794,700 | 3/1931 | McCaskey | 248/221.3 |
| 3,612,590 | 10/1971 | Andreini et al. | 292/76 |
| 4,176,580 | 12/1979 | Gallegos | 248/224.1 X |
| 4,280,638 | 7/1981 | Kelhm | 222/180 |
| 4,340,199 | 7/1982 | Brock | 248/221.3 |
| 4,461,445 | 7/1984 | Williamson et al. | 222/181 |

FOREIGN PATENT DOCUMENTS

| | | | |
|---|---|---|---|
| 215495 | 6/1958 | Australia | 222/181 |
| 972049 | 7/1975 | Canada | 340/620 |

*Primary Examiner*—L. J. Paperner
*Assistant Examiner*—P. McCoy Smith
*Attorney, Agent, or Firm*—John E. Toupal; Harold G. Jarcho

[57] ABSTRACT

The invention is a liquid dispenser including a container for retaining a liquid to be dispensed and comprising a mounting plate portion having a downwardly opening slot defined by a slot edge, a front surface bounding the slot, and a rear surface for juxtaposition a support surface; and a bracket comprising a body portion with a back surface for engaging the support surface, a wall bordering the body portion and extending transversely to the support surface, and a skirt projecting from the wall and spaced from and substantially parallel to the support surface. The wall engages the slot edge so as to provide vertical support for the container and the skirt and the support surface straddle and engage the front surface and the rear surface plate portion, respectively, so as to provide horizontal support for the container.

19 Claims, 8 Drawing Figures

DISPENSER MOUNTING SYSTEM

BACKGROUND OF THE INVENTION

This invention relates generally to a liquid dispenser and, more particularly, to a liquid dispenser suitable for mounting on a vertical wall.

An extensive variety of liquid products including soaps, hand lotions, cleaning compounds, etc. are delivered for use from containers by either hand or foot operated pumps. Generally, the pump operated dispensers are conveniently mounted on a wall of a facility such as a washroom or storeroom. To facilitate removal for filling, servicing or cleaning, pump operated dispensers typically are removably supported by wall mounted brackets. Examples of wall bracket mounted liquid dispensers are disclosed in U.S. Pat. Nos. 2,605,021 and 2,665,825.

Prior wall bracket mounted dispensers have exhibited a number of deficiencies. Some wall brackets fail to provide positive retention and therefore abet inadvertent removal of the liquid dispenser. Other types alleviate that problem with retention mechanisms that exhibit other disadvantages such as increased cost or requirements for time consuming latching procedures. Unattractive appearance and resistance to convenient clean up are still other deficiencies of prior, wall mounted liquid dispensers.

The object of this invention, therefore, is to provide an improved, easily removable wall bracket mounted liquid dispenser.

SUMMARY OF THE INVENTION

The invention is a liquid dispenser including a container for retaining a liquid to be dispensed and comprising a mounting plate portion having a downwardly opening slot defined by a slot edge, a front surface bounding the slot, and a rear surface for juxtaposition a support surface; and a bracket comprising a body portion with a back surface for engaging the support surface, a wall bordering the body portion and extending transversely to the support surface, and a skirt projecting from the wall and spaced from and substantially parallel to the support surface. The wall engages the slot edge so as to provide vertical support for the container and the skirt and the support surface straddle and engage the front surface and the rear surface plate portion, respectively, so as to provide horizontal support for the container. This arrangement provides an attractive, easily removed dispenser suitable for mounting on a vertical wall.

A preferred embodiment of the invention includes a releaseable latch for latching the plate portion to the bracket. The latch insures positive retention of the container on the bracket.

According to particular features of the invention, the latch comprises a resilient tab portion having one end fixed to the bracket and an opposite end movable away from the support surface, an aperture, and a pin portion projecting substantially perpendicular to the support surface and received by the aperture. The resilient tab portion is operable to remove the pin portion from the aperture to allow disengagement of the container and the bracket.

According to other features of the invention, the slot edge comprises a pair of side edges and a top edge, and the wall comprises a pair of side walls each engaging one of the side edges and a top wall supporting the top edge; and the skirt comprises a skirt portion substantially coextensive with the side and top edges. This arrangement provides the container with sturdy support and easy removability.

According to still other features of the invention, the tab portion projects from the bracket means, is spaced from and substantially parallel to the support surface, and is substantially parallel and adjacent to one of the side walls; the aperture is formed in the front surface and the pin portion projects from the opposite end of the tab portion. This arrangement facilitates molding of the bracket and latch as an integral unit.

According to a further feature of the invention, the dispenser includes a stop for limiting the maximum travel of the opposite end of the tab portion. The stop prevents excessive movement that could shear the tab portion.

In one featured embodiment, the stop comprises a rigid arm extending from the body portion and disposed to engage and thereby limit travel of the tab portion. This arrangement facilitates molding of the bracket, latch and stop as an integral unit.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
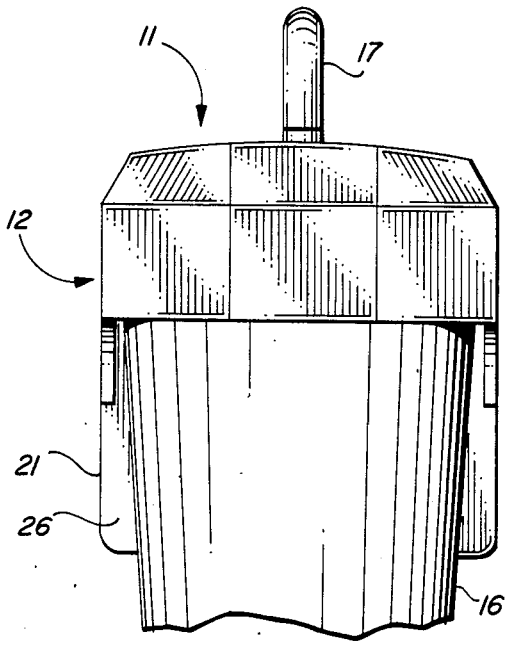
FIG. 1 is a schematic front view of a wall mounted liquid dispenser according to the invention.
Figure 2:
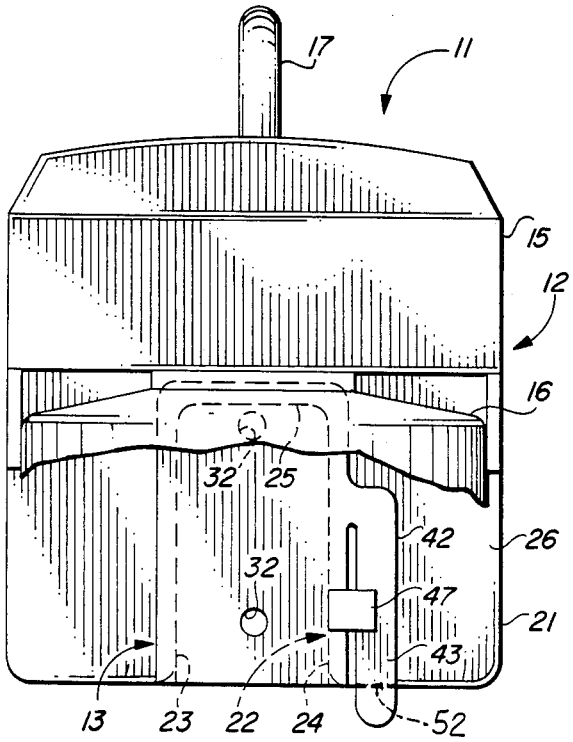
FIG. 2 is a schematic front view of the dispenser with a container portion removed.

Illustrated in FIGS. 1–5 is a liquid dispenser 11 according to the invention. The dispenser 11 includes a container 12 and supporting bracket 13 that is adapted for mounting on a vertical support surface 14 (FIG. 5) such as a washroom wall. The container 12 includes a cover 15, a bowl 16 demountably retained by the cover 15 and a nozzle 17 supported by the cover 15 and communicating with the bowl 16. A conventional fluid pump (not shown) can be actuated to force liquid retained by the bowl 16 out of the nozzle 17.

The cover 15 includes a mounting plate portion 21 that defines a centrally located, downwardly opening slot 22. Forming the periphery of the slot 22 are vertically disposed side edges 23, 24 and a horizontally disposed top edge 25. A front surface 26 bounds the downwardly opening slot 22 while an oppositely facing rear surface 27 is arranged to lie substantially parallel to the support surface 14. Extending through the plate portion 21 adjacent the right side edge 24 of the slot 22 is an aperture 28.

Figure 5:
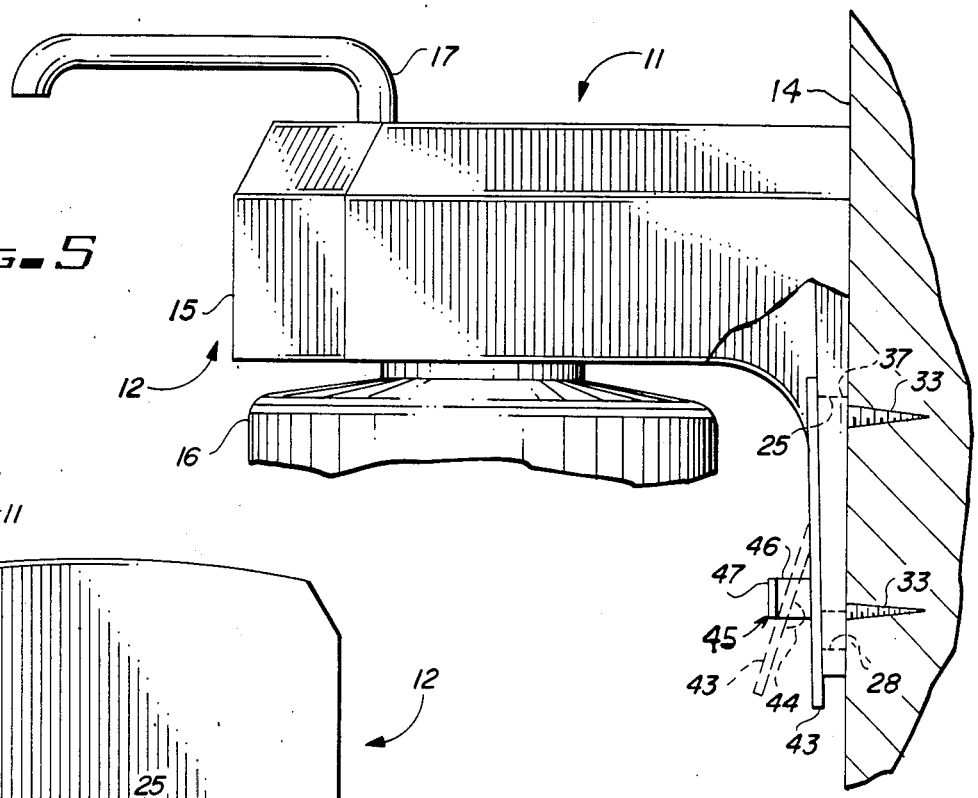
FIG. 5 is a schematic right side view of the dispenser shown in FIG. 1.
Figure 4:
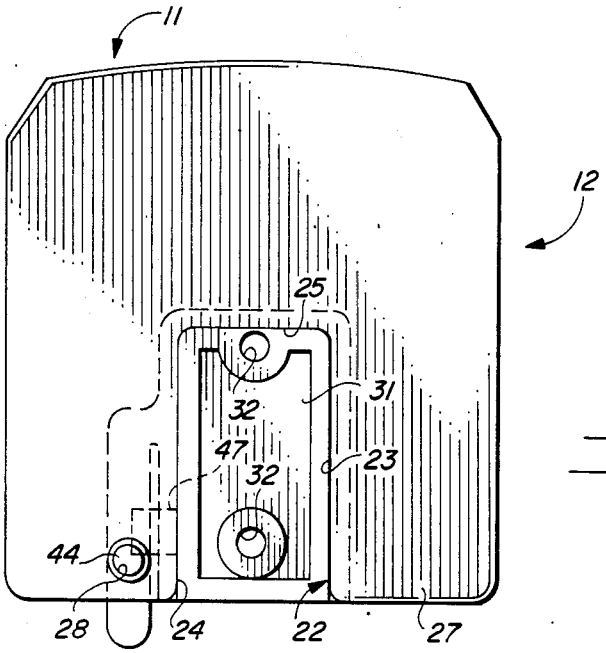
FIG. 4 is a schematic rear view of the dispenser shown in FIG. 1.
Figure 6:
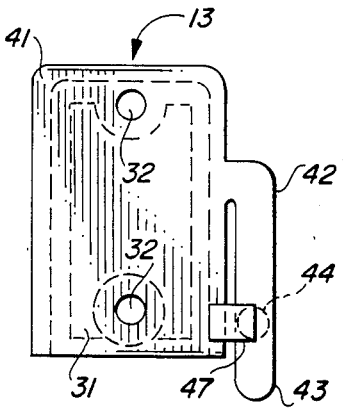
FIG. 6 is a schematic front view of a support bracket shown in FIGS. 2–5.
Figure 8:
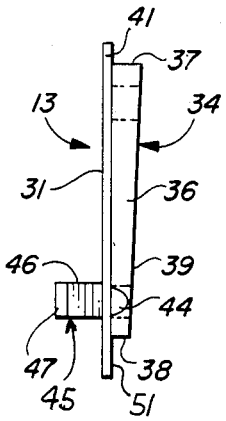
FIG. 8 is a schematic right side view of the support bracket shown in FIGS. 6 and 7.
Figure 7:
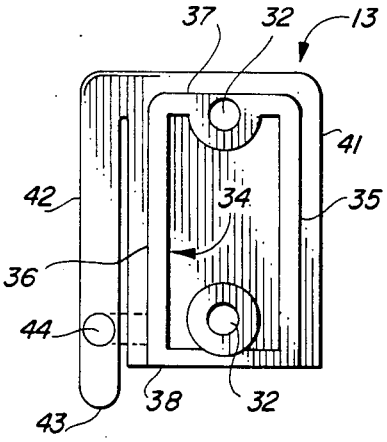
FIG. 7 is a schematic rear view of the support bracket shown in FIG. 6.

The bracket 13 shown more clearly in FIGS. 6–8 includes a body portion 31 having vertically spaced apart openings 32. Securing the bracket 13 to the support surface 14 are screws 33 (FIG. 5) that are accommodated by the openings 32. A rectangularly shaped web portion 34 projects rearwardly from the body portion 13 and is transverse to the support surface 14. Forming the outer periphery of the web portion 34 are side walls 35, 36 a top wall 37 and a bottom wall 38. A back surface 39 of the web portion 34 engages the support surface 14. Extending outwardly from the body portion 31 and spaced from and substantially parallel to the support surface 14 is a skirt 41 that is coextensive with the side walls 35, 36, and the top wall 37 of the web portion 34. A flexible tab portion 42 of the bracket 13 has one end joined to the skirt 41 and extends parallel to the side wall 36 and spaced from and parallel to the support surface 14. Projecting from an opposite, movable end 43 of the tab portion 42 is a pin 44 that extends perpendicular to the support surface 14. Also projecting from the body portion 31 is a limit arm 45 that includes a stem portion 46 extending outwardly from the body portion 31 and a transverse stop portion 47 that overlies the movable end 43 of the tab portion 42.

During installation, the bracket 13 is mounted in a convenient location on a suitable wall surface 14 with the screws 33 (FIG. 5). Initially, at least the upper screw 33 is loosely secured to insure between the surface 14 and the back surface 39 of the web portion 34 sufficient clearance to accommodate the cover 15 which then is mounted by sliding the slot 22 of the mounting plate portion 21 over the web portion 34 of the bracket 13 and behind the skirt 41. After mounting of the cover 15, the screws 33 are tightened to establish between the surface 14 and the bracket 13 an optimum clearance that prevents excessive horizontal movement of the plate portion 21 while permitting upwardly directed movement thereof. This mounting procedure compensates for molding tolerance caused dimensional variations in mating portions of the cover 15 and the bracket 13. Once the screws 33 are tightened, the bowl 16 can be secured to the cover 15 which is supported vertically by engagement between the top edge 25 (see FIG. 4) of the slot 22 and the top wall 37 (FIGS. 8 and 7) of the web portion 34. Horizontal retention of the cover 15 is provided in one dimension by engagement between the side edges 23, 24 (FIG. 4) of the slot 22 and the side walls 35, 36 (FIG. 7) of the web portion 34 and in another dimension by engagement between the front surface 26 (FIG. 2) of the mounting plate 21 and a rear surface 51 (FIG. 8) of the skirt 41.

Figure 3:
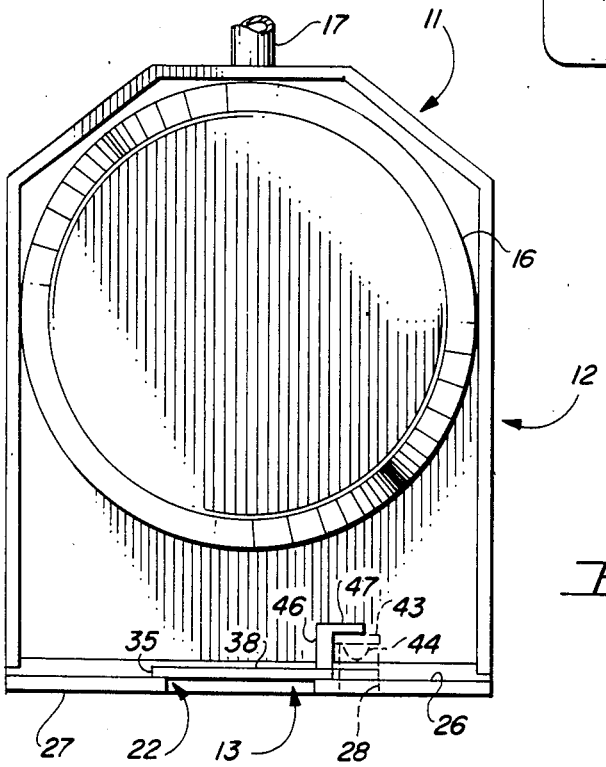
FIG. 3 is a schematic bottom view of the dispenser shown in FIG. 1.

As the cover 15 is being mounted on the bracket 13, a bottom edge 52 (FIG. 2) of the mounting plate portion 21 engages the pin 44 and forces the outer end 43 of the tab portion 42 outwardly as shown by dashed lines in FIGS. 3 and 5. After the top edge 25 of the slot 22 is seated on the top wall 37 of the web portion 34, the outer end 43 of the resilient tab portion 42 returns inwardly to its natural position as the pin 44 enters the aperture 28 in the mounting plate portion 21. This engagement between the pin 44 and the aperture 28 securely latches the cover 15 to the bracket 13. When removal of the cover 15 is desired, the outer end 43 of the tab portion 42 is deflected outwardly to remove the pin 44 from the aperture 28 and thereby allow removal of the mounting plate portion 21 from the bracket 13. During this removal operation, excessive deflection of the tab portion 42 is prevented by engagement between the outer end 43 and the stop portion 47 of the limit arm 45 as shown by dashed lines in FIGS. 3 and 5. By limiting travel of the tab portion 42, inadvertent shearing thereof from the body portion 31 of the bracket 13 is prevented.

Obviously, many modifications and variations of the present invention are possible in light of the above teachings. It is to be understood, therefore, that the invention can be practiced otherwise than as specifically described.

What is claimed is:

1. A liquid dispenser comprising:

container means comprising a bowl for retaining a liquid to be dispensed and a mounting plate portion demountably retaining said bowl and having a downwardly, forwardly and rearwardly opening slot defined by a slot edge means, a front surface bounding said slot, and a rear surface adapted to be justaposed to a support surface; and bracket means comprising a body portion with a back surface for engaging the support surface and defining openings for fasteners for securing said bracket means to the support surface, wall means extending transversely to the support surface, and skirt means projecting from said wall means and spaced from and substantially parallel to the support surface; said wall means engaging said slot edge means so as to provide vertical support for said plate portion, and said skirt means and the support surface engaging said front surface and said rear surface, respectively, so as to provide horizontal support for said plate portion, and wherein said openings are justaposed to and accessible via said slot.

2. A liquid dispenser according to claim 1 including releaseable latch means latching said plate portion to said bracket means.

3. A liquid dispenser according to claim 2 wherein said latch means comprises a resilient tab portion having one end fixed to said bracket means and an opposite end movable away from the support surface, an aperture, and a pin portion projecting substantially perpendicular to the support surface and received by said aperture; said resilient tab portion being operable to remove said pin portion from said aperture to allow disengagement of said container means and said bracket means.

4. A liquid dispenser according to claim 3 wherein said slot edge means comprise a pair of side edges and a top edge, and said wall means borders said body portion and comprises a pair of side walls each engaging one of said side edges and a top wall supporting said top edge.

5. A liquid dispenser according to claim 4 wherein said skirt means comprises a skirt substantially coextensive with said side and top walls.

6. A liquid dispenser according to claim 5 wherein said tab portion projects from said bracket means and is spaced from and substantially parallel to the support surface.

7. A liquid dispenser according to claim 6 wherein said tab portion is substantially parallel and adjacent to one of said side walls.

8. A liquid dispenser according to claim 7 wherein said aperture is formed in said front surface and said pin portion projects from said opposite end of said tab portion.

9. A liquid dispenser according to claim 8 wherein said bracket means and said latch means are an integrally molded unit.

10. A liquid dispenser according to claim 9 including limit means for limiting the maximum travel of said opposite end of said tab portion.

11. A liquid dispenser according to claim 10 wherein said limit means comprises a rigid arm extending from said body portion and disposed to engage and thereby limit travel of said tab portion.

12. A liquid dispenser comprising:

container means for retaining a liquid to be dispensed and including a mounting plate portion;

bracket means comprising a body portion with a back surface for engaging a support surface, wall means extending transversely to the support surface, and skirt means projecting from said wall means and spaced from and substantially parallel to the support surface, said wall means engaging said plate portion so as to provide vertical support for said container means and said skirt means engaging said plate portion so as to provide horizontal support thereof;

releaseable latch means latching said plate portion to said bracket means, said latch means comprising a resilient tab portion having one end fixed to said bracket means and an opposite end movable away from the support surface, an aperture, and a pin portion projecting substantially perpendicular to the support surface and received by said aperture, said resilient tab portion being movable in a given direction to remove said pin portion from said aperture to allow disengagement of said container means and said bracket means; and limit means on either said bracket means or said mounting plate portion for limiting the maximum travel of said opposite end of said tab portion is said given direction so as to prevent breakage thereof.

13. A liquid dispenser according to claim 12 wherein said tab portion projects from said bracket means and is spaced from and substantially parallel to the support surface.

14. A liquid dispenser according to claim 13 wherein said mounting plate portion has a body portion that defines a downwardly opening slot comprising a pair of side edges and a top edge, a front surface bounding said slot, and a rear surface adapted to be juxtaposed at the support surface and said wall means borders said wall portion and comprises a pair of side walls each engaging one of said side edges and a top wall supporting said top edge.

15. A liquid dispenser according to claim 14 wherein said tab portion is substantially parallel and adjacent to one of said side walls.

16. A liquid dispenser according to claim 15 wherein said aperture is formed in said front surface, and said pin portion projects from said opposite end of said tab portion.

17. A liquid dispenser according to claim 16 wherein said limit means comprises a rigid arm extending from said body portion and disposed to engage and thereby limit travel of said tab portion.

18. A liquid dispenser according to claim 17 wherein said bracket means, said latch means and said limit means comprise an integrally molded unit.

19. A method of installing a liquid dispenser including a container for retaining a liquid to be dispensed and with a mounting plate portion having a front surface and a rear surface for juxtaposition to a support surface, and defining a downwardly, forwardly and rearwardly opening slot extending between said front and rear surfaces; and a bracket comprising a body portion with a back surface for engaging the support surface, a wall extending transversely to the support surface and a skirt projecting from the wall and spaced from and substantially parallel to the support surface, the wall engageable with the plate portion so as to provide vertical support thereof and the plate portion being engageable between the skirt and the support surface so as to be horizontally retained thereby and wherein said body portion defines openings for fasteners for securing said bracket to the support surface, said openings being juxtaposed to and having unlimited accessibility in a direction normal to said back surface via said slot; the method including the steps of:

loosely securing said bracket to the support surface with the fasteners;

positioning said plate portion between said skirt and the support surface; and more tightly securing said bracket to the support surface with the fasteners so as to provide therebetween a clearance that horizontally retains said plate portion while permitting upwardly directed movement thereof.

* * * * *